US005099968A

United States Patent [19]

Kikuchi

[11] Patent Number: 5,099,968

[45] Date of Patent: Mar. 31, 1992

[54] SUITCASE ASSEMBLY

[76] Inventor: Takeshi Kikuchi, 6-23, Shinmei-Cho, Morioka-Shi, Iwate-Ken 020, Japan

[21] Appl. No.: 701,818

[22] Filed: May 17, 1991

[51] Int. Cl.[5] ..... A45C 7/00

[52] U.S. Cl. ..... 190/108; 206/504; 206/511; 220/23.6

[58] Field of Search ..... 190/8, 108; 206/504, 206/511, 818; 150/111; 220/23.6

[56] References Cited

U.S. PATENT DOCUMENTS

| | | | |
|---|---|---|---|
| 1,084,360 | 1/1914 | Rahm | 190/108 |
| 3,103,278 | 9/1963 | Kuzma et al. | 206/511 |
| 3,828,927 | 8/1974 | Schoeller | 220/23.6 |
| 3,831,832 | 8/1974 | Gray | 206/818 |
| 4,813,542 | 3/1989 | Thompson et al. | 220/23.6 |
| 4,922,811 | 5/1990 | Stumpf | 206/818 |
| 4,940,143 | 7/1990 | Stanfield | 206/511 |
| 4,995,436 | 2/1991 | Cantor | 190/108 |

FOREIGN PATENT DOCUMENTS

| | | | |
|---|---|---|---|
| 1194618 | 11/1959 | France | 220/23.6 |
| 1-155821 | 10/1989 | Japan . | |

*Primary Examiner*—Gary E. Elkins

[57] ABSTRACT

A suitcase assembly consisting of at least two suitcase components each of which having a generally rectangular configuration. Projections and/or recesses are provided on each of the suitcase components for detachably connecting the suitcase components in vertically overlapping relationship and also in side-by-side relationship. The projections and/or recesses for connecting the suitcase components have opposing flat surface portions and opposing unclaimed surface portions.

7 Claims, 2 Drawing Sheets

SUITCASE ASSEMBLY

FIELD OF THE INVENTION

The present invention relates generally to a suitcase for receiving therein clothes and the like for use during a short trip, an oversea journey or the like.

DESCRIPTION OF THE PRIOR ART

Various types and size of suitcases have been widely used for carrying clothes and the like for use during a short trip or oversea journey or the like. The size of a well known suitcase ranges between 61×47×22 cm to 75×56×26 cm in the size of length×width×thickness. And suitcases or luggage trunks having much larger size are also known and utilized.

It is sometimes too heavy to carry such suitcase for a person. For aiding the carrying operation, there are usually provided casters on one or more side surfaces so that the person carrying the suitcase can pull or push it along the floor. Although such pulling or pushing is relatively easy, it is required to lift up and carry the suitcase on rough roads, sloped surface, stairs or the like. In such case, it is rather easy to carry two luggages by both hands.

The present invention has been made in view of the circumstances aforementioned, and aims to provide a novel suitcase assembly which permits a person to assemble two or more suitcase components into one suitcase assembly when required and to break down into respective suitcase components which can easily be carried by such as respective hands.

SUMMARY OF THE INVENTION

According to the invention, there is provided a suitcase assembly consisting of at least two suitcase components each of which having a generally oblong rectangular prism like configuration. There are provided on each of the suitcase components means for detachably connecting the suitcase components in vertically overlapping relationship and also in side-by-side relationship. When the two suitcase components are connected vertically overlappingly the width and the depth of respective suitcase components are respectively generally equal with each other, and when the suitcase components are connected side-by-side the upper surfaces thereof are located in a common plane. The connecting means comprises at least one projection member provided on each of at least two surfaces of one of the suitcase components and at least one corresponding recess member provided on each of at least two surfaces of the other of the suitcase components.

Preferably, the projection member fittingly engage with corresponding recess member, and further preferably, the engaging condition is maintained by magnetic force or the like.

According to the invention, the size of the suitcase component can be reduced such that each suitcase component can be carried easily by one hand and yet the total capacity of the suitcase assembly can be maintained as large as usual suitcases.

Further, when the two suitcase components are connected in side-by-side relationship the assembly can be utilized as a temporal chair and it is effective to prevent burglar since the assembly is too bulky to move by one person.

BRIEF DESCRIPTION OF THE DRAWINGS

Further objects and effects of the invention will become apparent from the following detailed description in conjunction with the drawings, in which.

DETAILED DESCRIPTION OF PREFERRED EMBODIMENTS

Figure 1:
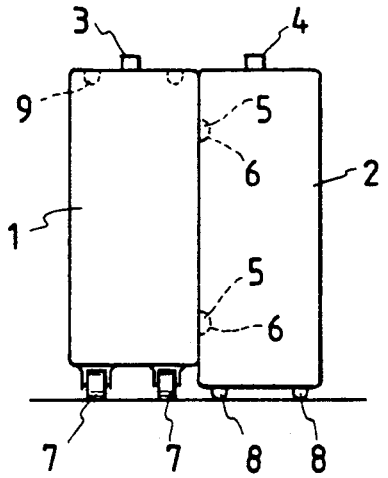
FIG. 1 is a front view of a suitcase assembly according to a preferred embodiment of the invention and in the assembled condition.
Figure 2:
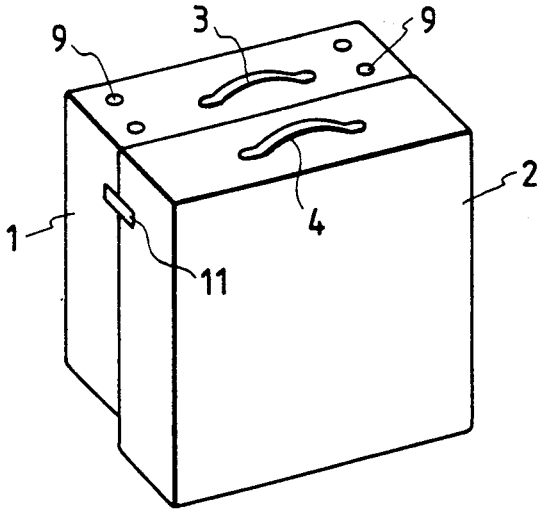
FIG. 2 is a perspective view of the suitcase assembly of FIG. 1.

FIGS. 1–4 show a first embodiment according to the invention, which comprises a first suitcase component 1 and a second suitcase component 2. Each of the suitcase components 1 and 2 has a generally oblong rectangular prism like configuration and the corner portions and edge portions of which are rounded suitably (not shown in the drawings). In FIGS. 1 and 2, the suitcase components 1 and 2 are connected in side-by-side relationship.

Figure 5:
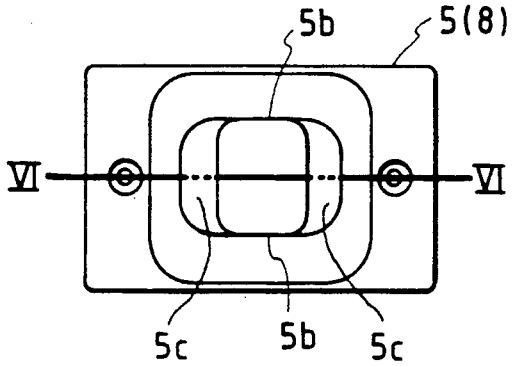
FIG. 5 is a plan view of a projection member mounted on a suitcase component of the suitcase assembly of FIG. 1.
Figure 6:
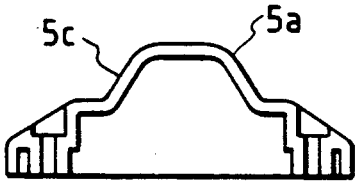
FIG. 6 is a longitudinal section view taken generally along line 6—6 in FIG. 5.

The suitcase components 1 and 2 have respectively handle portions 3 and 4 of conventional type, connectors 5 and 6 which will be explained hereinafter in detail with reference to FIGS. 5–8, and connectors 8 and 9 of the construction similar to that of the connectors 5 and 6 respectively. The connectors 8 and projection members as shown in FIGS. 5 and 6 and act as temporary legs or pedestals when the suitcase component 2 is carried separating form and independently of the suitcase component 1 and, during the condition of FIG. 1, the connectors 8 or the temporal legs are spaced from the surface of the floor by a small distance.

Further, casters 7 are provided on the first suitcase component 1. Preferably, preparatory handles 13 and 12 are provided on the first and second suitcase components 1 and 2 respectively on respective sides different from those having the handles 3 and 4 respectively. The preparatory handles enable to carry respective suitcase components at different attitudes, but it will be understood that such handles 13 and 12 may be omitted.

Shown at 10 and 11 are connectors of such as conventional latch type which assures the connected conditions. The connectors 10 and 11 may be omitted since the connected conditions shown in FIGS. 1 through 4 can reliably be maintained by the engagement of the connectors or the projection members 8 or 5 with the connectors or the recess members 9 or 6 during usual pushing or pulling operation. Further, the connectors 10 and 11 may be substituted by belt and the like.

Although not shown in the drawings there are provided suitably pulling cord on the suitcase component 2 for aiding the pulling operation.

Each of the suitcase components 1 and 2 has usual construction consisting of a main body portion, a lid portion connected to the main body portion through hinge means, and latch means having a lock (these elements are not shown in the drawings); and is formed of suitable rigid and light weight material such as synthetic resin, light metal such as aluminium alloy, fabric and the like.

Figure 3:
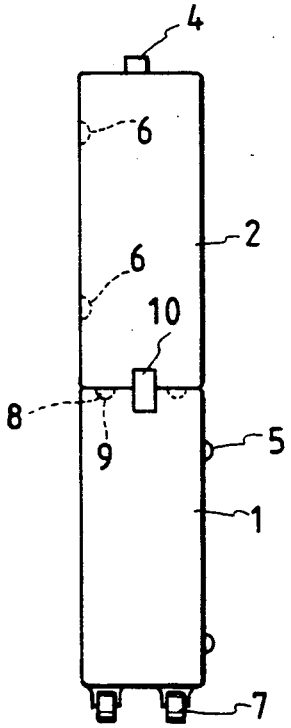
FIG. 3 is a front view of the suitcase assembly of FIG. 1 in another assembled condition.
Figure 4:
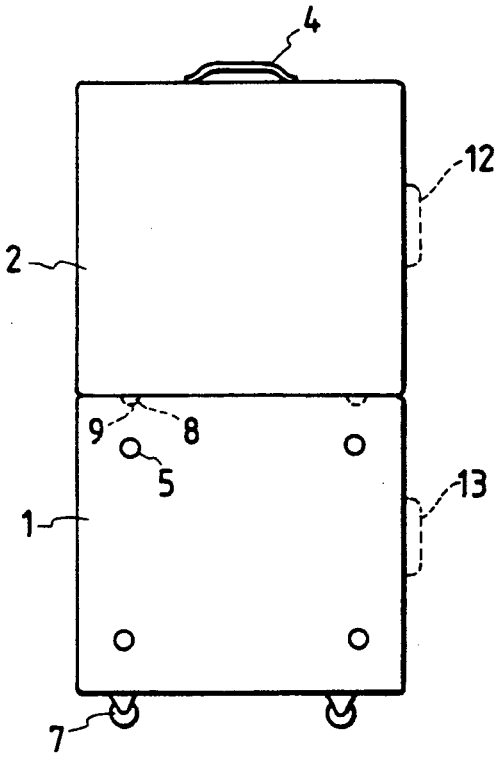
FIG. 4 is a side view of FIG. 4.

Preferably size of the suitcase assembly is
the height shown in FIG. 1 is about 100 cm,
the width shown in FIG. 4 is about 64 cm,
the width shown in FIG. 3 is about 23 cm, and
the diameter of the casters 7 is about 5.5 cm.

It will be understood that the height 100 cm consists of the height 49 cm of the main body of the suitcase component 2 plus height 45 cm of the main body of the suitcase component 1 plus 6 cm of the caster 7.

The above mentioned size may be changed as desired.

When the suitcase assembly takes the form of FIGS. 3 and 4, it is very easy to push or pull the assembly. Further, the assembly does not occupy much space as compared with conventional suitcase, and it is possible to lean onto the suitcase assembly since the overall height is higher than that of conventional suitcase.

Figure 7:
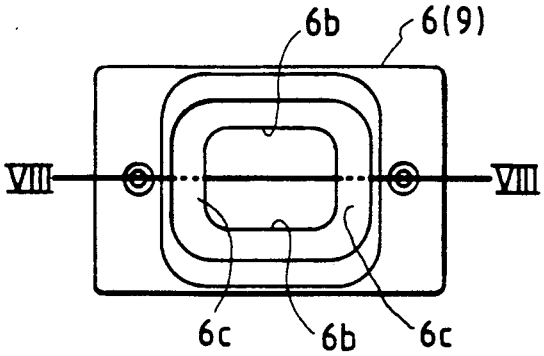
FIG. 7 is a plan view of a recess member mounted on another suitcase component of the suitcase assembly of FIG. 1.
Figure 8:
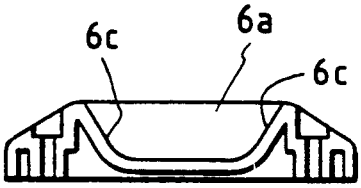
FIG. 8 is a longitudinal section view taken generally along line 8—8 in FIG. 7.

FIG. 5 through FIG. 8 show connecting means according to a preferred embodiment, in which FIGS. 5 and 6 show a projection member 5 and FIGS. 7 and 8 show a recess member 6. Preferably, the projection member 5 and the recess member 6 are formed of steel, aluminium alloy, synthetic resin material or the like. Further, either one of the projection member and the recess member may be formed of a material having permanent magnet property and the other member of magnetic material such that both members are maintained in engaging condition by magnetic force. The magnetic force may be afforded by electromagnet.

As shown in FIG. 5 through FIG. 8, the recess member 6 has opposing two flat side surface portions **6*b* and 6*b* and opposing two inclined side surface portions 6*c* and 6*c*, and, corresponding two flat surface portions 5*b* and 5*b* and opposing two inclined surface portions 5*c* and 5*c* are formed on the projection member 5, whereby relative movement between the suitcase components 1 and 2 is restricted by the engagement of the flat side surface portions 5*b*, 5*b* and 6*b*, 6*b* of the projection member 5 and the recess member 6. The flat surface portions of the projection member 8 and the recess member 9 corresponding respectively the flat surface portions 5*b*, 5*b* and 6*b*, 6*b* are located such that each flat surface is perpendicular to or to left and right directions in FIG. 4** for pushing or pulling the suitcase assembly.

Preferably, four projection members 5 or 8 are provided on one side surface of either one of the suitcase components 1 and 2 and four recess members 6 or 9 are provided on the other suitcase component with the flat surface portions being arranged in the same direction with respect to diagonally arranged two projection members and two recess members, and in the direction perpendicular to the above mentioned two projection members and two recess members flat surface portions being arranged on the two projection members and two recess members on the other diagonal line. Such arrangement can effectively prevent the relative movement between the components 1 and 2 reliably.

It will be understood that the flat surface portions may not necessarily be parallel to each other, and the function preventing the relative movement is due to the relatively large contacting area between the flat surfaces.

According to the invention, it is possible to reduce the size of each suitcase component while maintaining the total content compatible to large size suitcases.

When the suitcase components are vertically overlapingly connected, the height may be larger than that of conventional large size suitcase, but it is easy to push or pull along a flat floor or a load and, as compared with conventional suitcase the overall height is higher, thus, it is easy to lean on the assembly, and on an inclined surface, stairs or the like, the assembly can easily be disassembled into respective suitcase components which are easy be carried by respective hands.

Further, when the suitcase components are connected in side-by-side relation, the assembly can be utilized as a temporal chair and the size thereof is too bulky to carry it, thereby it is effective to prevent burglar.

By providing corresponding projection members and recess members on respective suitcase components, it is possible to reliably maintain the assembled condition and to disassemble or to separate into respective suitcase components as desired.

It will be under stood that the present invention is not limited by the embodiment and that various changes and modifications can easily by made for those skilled in the art without departing from the gist of the present invention.

For example, the projection member and the recess member shown in the embodiment may be changed as desired provided that both members can easily be connected and disconnected as desired. For example, the connecting means may include electrically actuated projection and recess means such as electro-magnet or the like.

The size or dimensions and the configuration of the suitcase component and of constituting members may be determined as desired.

What is claimed is:

1. A suitcase assembly consisting of first and second suitcase components each of which having a generally oblong rectangular configuration, each said configuration having a top surface, a bottom surface, a front surface, a rear surface and two opposing side surfaces; and, on the first suitcase component there are provided on the bottom surface thereof a plurality of caster wheels, in the top surface a plurality of recesses, and on one side surface means for locating and detachably connecting said first suitcase component with said second suitcase component in side-by-side relationship; on the second suitcase component there are provided, on the bottom surface thereof a plurality of projections with the size and locations thereof corresponding to the recesses in the top surface of the first suitcase component, and on one side surface means for locating and detachably connecting the second suitcase component with the first component in side-by-side relationship; and said projections formed on the bottom surface of the second suitcase component act, when the suitcase components are arranged in said side-by-side relationship, as supporting legs.

2. A suitcase assembly according to claim 1 wherein said means for locating and detachably connecting the suitcase components are projection members on one of said suitcase components and recess members in the other of said suitcase components, each of said projection and recess members having two opposing flat surface portions and two opposing inclined surface portions, whereby relative movement between the suitcase components is restricted by the engagement of the flat surface portions of the recess members with flat surface portions of the projection members.

3. A suitcase assembly according to claim 2 wherein the projection members maintain the engaging condition with the recess members by magnetic force.

4. A suitcase assembly according to claim 3 wherein the magnetic force is afforded by permanent magnets.

5. A suitcase assembly according to claim 2 wherein said means on said one side surface of said first suitcase component includes four projection members located adjacent corners of said one side;

said means on said one side surface of said second suitcase component includes four recess members located adjacent corners of said one side;

and said flat portions of said projection and recess members are arranged in parallel in tow of said projection and recess members which are located at corners diagonally opposite from each other and in a direction perpendicular to said parallel direction with respect to the other two of said projection and recess members at the remaining corners.

6. A suitcase assembly according to claim 1 wherein each of the suitcase components is provided at least one carrying handle.

7. A suitcase assembly according to claim 2 wherein each of the suitcase components is provided at least one carrying handle.

* * * * *